US006160216A

United States Patent [19]

McMahon

[11] Patent Number: 6,160,216

[45] Date of Patent: Dec. 12, 2000

[54] WIRING HARNESS SHIELD SPLITTER

[75] Inventor: Roy P. McMahon, Indianapolis, Ind.

[73] Assignee: Raytheon Company, Lexington, Mass.

[21] Appl. No.: 09/228,594

[22] Filed: Jan. 12, 1999

[51] Int. Cl.[7] ..... H01B 11/06

[52] U.S. Cl. ..... 174/36; 174/102 R

[58] Field of Search ..... 174/36, 35 C, 174/35 R, 72 A, 71 R, 72 R

[56] References Cited

U.S. PATENT DOCUMENTS

| | | | |
|---|---|---|---|
| 3,803,340 | 4/1974 | Jachimowicz et al. | 174/36 |
| 3,817,783 | 6/1974 | Verne et al. | 117/226 |
| 3,968,321 | 7/1976 | Olszewski et al. | 174/36 |
| 4,165,442 | 8/1979 | Gabriel et al. | 174/36 |
| 4,453,031 | 6/1984 | Justiss | 174/36 |
| 5,541,361 | 7/1996 | Frieson et al. | 174/34 |

*Primary Examiner*—Kristine Kincaid
*Assistant Examiner*—William H. Mayo, III
*Attorney, Agent, or Firm*—William C. Schubert; Glenn H. Lenzen, Jr.

[57] ABSTRACT

A self-aligning shield splitter assembly (10) for splitting and shielding a wiring bundle (16) from an electromagnetic field and a method of assembling the same are provided. The shield splitter assembly (10) includes a first (12) and a second (14) hollow shield splitter. Each of the splitters (12, 14) defining an internal volume (36) for receiving a portion (54, 56) of the wiring bundle (16). Each of the splitters (12, 14) further includes open ends (32, 34) and a plurality of ridges (42, 44, 46) disposed along an exterior portion of the splitter (12, 14). The plurality of ridges (42, 44, 46) are perpendicular to a longitudinal axis of the splitter (12, 14). A plurality of braided shields (20, 22, 24) is provided individually surrounding the first splitter (12), the second splitter (14), and the wiring bundle (16). The plurality of braided shields (20, 22, 24) minimizes penetration of electromagnetic fields into the wiring bundle (16). At least one retaining band (26, 28) is also provided for securing the first splitter (12), the second splitter (14), and the plurality of braided shields (20, 22, 24) together. The retaining band (26, 28) is positioned between the plurality of ridges (42, 44, 46) of the first (12) and second (14) splitters.

15 Claims, 6 Drawing Sheets

WIRING HARNESS SHIELD SPLITTER

FIELD OF THE INVENTION

The present invention relates to shield splitters for branching shielded wiring harnesses and, more particularly, to a shield splitter for forming a shielded joint at the branching point in order to minimize penetration of electromagnetic fields into the wiring harness.

BACKGROUND OF THE INVENTION

As is generally known, modern aircraft designs employ various control and avionics systems, such as radar and "black boxes," to aid in the operation of the aircraft. These control and avionics systems are typically interconnected using a plurality of wires, wherein these wires provide means for electrical communication between the systems.

As is known in the art, current in an electrical circuit creates a field of force associated with motion of the electrical charge. This field of force includes electric and magnetic components and, consequently, contains a finite amount of electromagnetic energy. This field of force is typically called an electromagnetic field. The electromagnetic field generated by an electrical circuit can induce current in an adjacent electrical circuit, thereby introducing noise into the adjacent circuit. This phenomenon also occurs in wires interconnecting the electrical circuits.

In aeronautic and astronautic applications, thousands of wires are routed throughout the aircraft in very tight bundles. As can be appreciated, these wires are susceptible to electromagnetic fields created by avionics on the aircraft and those near the aircraft, such as microwave towers or radar. If left unprotected, these electromagnetic fields induce noise into the wiring of the aircraft, thereby degrading the native signal carried in each of the wires. Moreover, because of the length of the wires extending through the aircraft, these wires act as very efficient antennas for picking up interference external to the aircraft.

Attempts have been made to shield these wires from the electromagnetic fields and outside interference. Typically, sensitive circuits, those unable to tolerate noise created from electromagnetic fields, are made using individual wires that are shielded. During manufacture, strands of copper are first plated using either tin, nickel, or silver and are then woven in place over the insulated wire to form a braided shield. Additional insulation is then put over the braided shield to form a cable, which is resistant to electromagnetic fields. Unsensitive circuits, those able to tolerate limited amounts of noise created from electromagnetic fields, are made according to conventional wire making methods.

During wiring of an aircraft, sensitive and unsensitive circuits are grouped together to form a wiring harness or bundle. To minimize noise or other interference caused by external electromagnetic fields, a braided shield is formed around the entire wiring bundle. Typically, this braided shield is formed on site by threading the wiring bundle into a braiding machine, which has a plurality of spools. These spools each contain strands of the shielding material, such as plated copper. When the braiding machine is activated, the wiring bundle is fed into the machine, and the strands are woven into place, thereby forming a braided shield over the entire wiring bundle.

During assembly of the aircraft, the wiring bundle is routed throughout the aircraft to the various control systems and avionics. At each control system or avionics, a portion of the wires are branched off from the wiring bundle to connect with the corresponding component. However, the portion of wires connected to the corresponding component must also be shielded to prevent the occurrence of noise caused by external electromagnetic fields. Therefore, prior to the routing of the wiring bundle through the aircraft, the operator must first feed one leg of the wiring bundle through the braiding machine to form a braided shield along the wiring bundle. The operator must then manipulate the now shielded wiring bundle to feed the unshielded leg of the wiring bundle through the braiding machine. Accordingly, this method is inefficient and requires the operator to have enormous skill with the braiding machine to manipulate the various branches of the wiring bundle. Furthermore, if the wiring bundle needs to be exposed for any reason in the future, such as for service, the machine braided shield must be cut to expose the wires. This cutting of the machine braided shield destroys the shield, thereby introducing electromagnetic fields into the wiring bundle, unless the shield is laboriously repaired.

Accordingly, there exists a need in the relevant art to provide a method for conveniently and effectively shielding branched wiring bundles in an aircraft or the like from external electromagnetic field sources without the use of a braiding machine. Furthermore, there exists a need in the relevant art to provide a device for splitting the braided shield to form a shielded joint at the branching point. Still further, there exists a need in the relevant art to overcome the disadvantages of the prior art.

SUMMARY OF THE INVENTION

In accordance with the broad teachings of this invention, an apparatus and method for splitting the braided shield of a wiring bundle to form a shielded joint is provided.

According to the teachings of the present invention, a self-aligning shield splitter assembly for splitting and shielding a wiring bundle from an electromagnetic field is provided. The shield splitter assembly includes a first and a second hollow shield splitter. Each of the splitters define an internal volume for receiving a portion of the wiring bundle. Each of the splitters further includes open ends and a first and a second ridge disposed along an exterior surface of the splitter. The first and second ridges are generally perpendicular to a longitudinal axis of the splitter. A plurality of braided shields is provided individually surrounding the first splitter, the second splitter, and the wiring bundle. The plurality of braided shields minimizes penetration of electromagnetic fields into the wiring bundle. At least one retaining band is also provided for securing the first splitter, the second splitter, and the plurality of braided shields together. The retaining band is positioned between the first and second ridges of the first and second splitters.

According to a preferred embodiment of the present invention, the plurality of braided shields includes a first braided shield for substantially enclosing the first splitter and the portion of the wiring bundle exiting the first splitter. A second braided shield is provided for substantially enclosing the second splitter and the portion of the wiring bundle exiting the second splitter. A third braided shield is lastly provided for substantially overlapping and enclosing the first splitter, the second splitter, and the wiring bundle entering the first and second shield splitters. Such overlapping of the third braided shield provides a shielded joint that is substantially equivalent to a continuous section of shield in providing protection to external electromagnetic fields. Furthermore, the first and second splitters each include a generally arcuate surface and a flat surface. The flat surfaces aid in aligning adjacent splitters during assembly.

The present invention further provides a method for splitting wires in a wiring bundle into branches. The method comprises the steps of first providing a wiring bundle having at least two wires. A first hollow splitter and a second hollow splitter are then provided. Each of the splitters includes open ends and defines an internal volume. Each of the splitters further includes a pair of ridges extending outwardly along an exterior surface of the splitter. The pair of ridges is generally perpendicular to a longitudinal axis of the splitter. The wiring bundle is then split into a first portion and a second portion. The first portion of the wiring bundle is inserted through the first splitter such that the first portion exits from the first splitter. Similarly, the second portion of the wiring bundle is inserted through the second splitter such that the second portion exits from the second splitter. A first braided shield and a second braided shield are then provided for minimizing electromagnetic field penetration. The first braided shield is slipped over the first portion of the wiring bundle and the first splitter. Similarly, the second braided shield is slipped over the second portion of the wiring bundle and the second splitter. A first retaining band is then provided for securing the splitters together. The first splitter is positioned adjacent the second splitter and the splitters are secured together with the retaining band. The splitters are positioned such that the retaining band overlaps the first and second braided shields and is positioned between the pair of ridges of the splitters in order to self-align the splitters.

According to a preferred method of the present invention, the method further includes the steps of providing a third ridge extending outwardly along the exterior surface of each splitter. The third ridge is generally perpendicular to the longitudinal axis of the splitter and spaced apart from the pair of ridges to form a space therebetween. A third braided shield is then provided for minimizing penetration of electromagnetic fields. The third braided shield is then slipped over the wiring bundle entering the first and second splitters such that it overlaps the splitters, the first and second braided shields, and the first retaining band. A second retaining band is provided for securing the third braided shield over the splitters and the first and second braided shields. The second retaining band is positioned in the space between the third ridge and the pair of ridges and is secured. This arrangement provides an overlapping joint that minimizes the penetration of electromagnetic fields into the wiring bundle.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses. For example, the present invention may have utility in minimizing electronic interference caused by external sources in a variety of different electronic applications.

Figure 1:
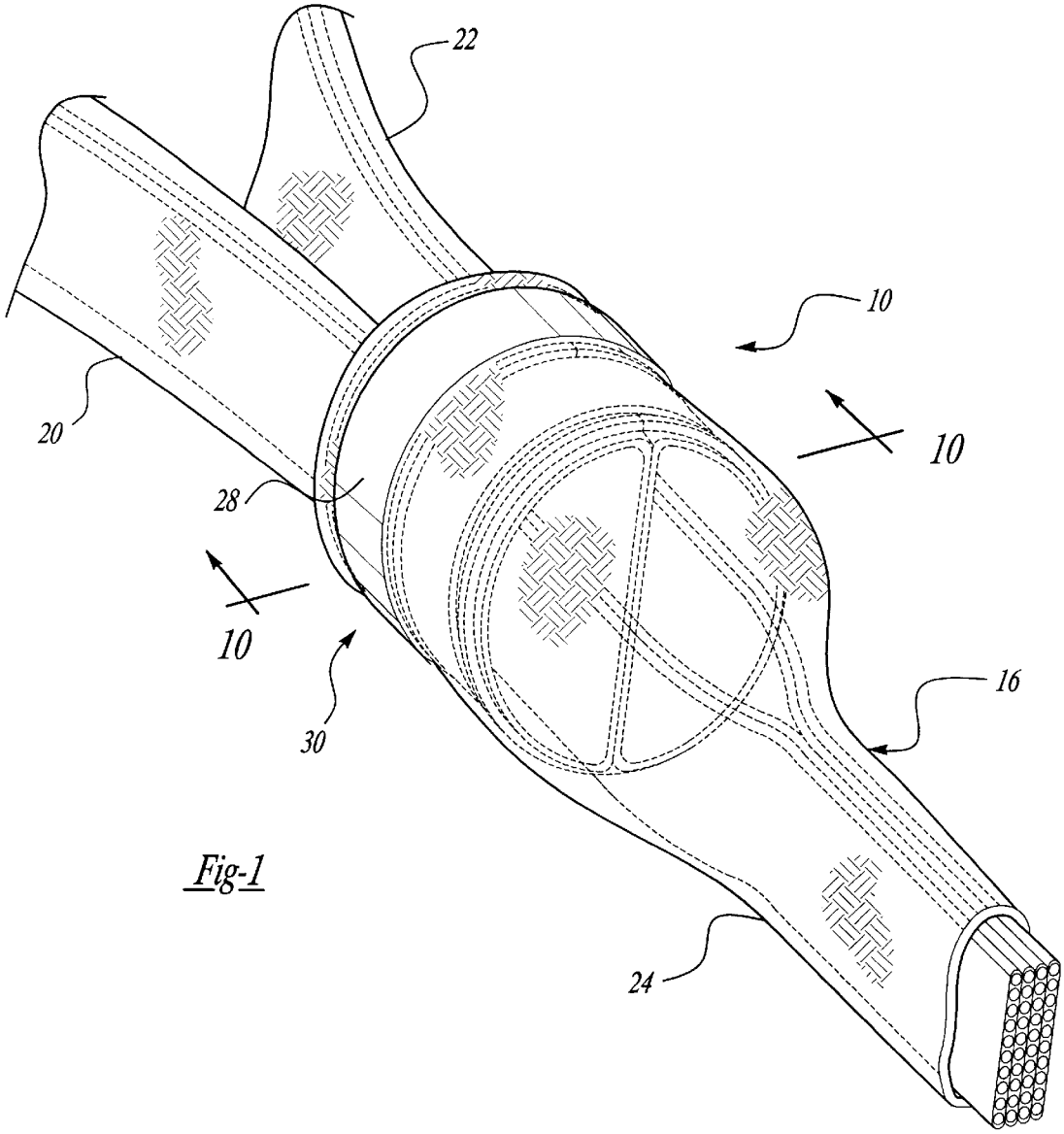
FIG. 1 is a perspective view of a shield splitter assembly according to the present invention.
Figure 2:
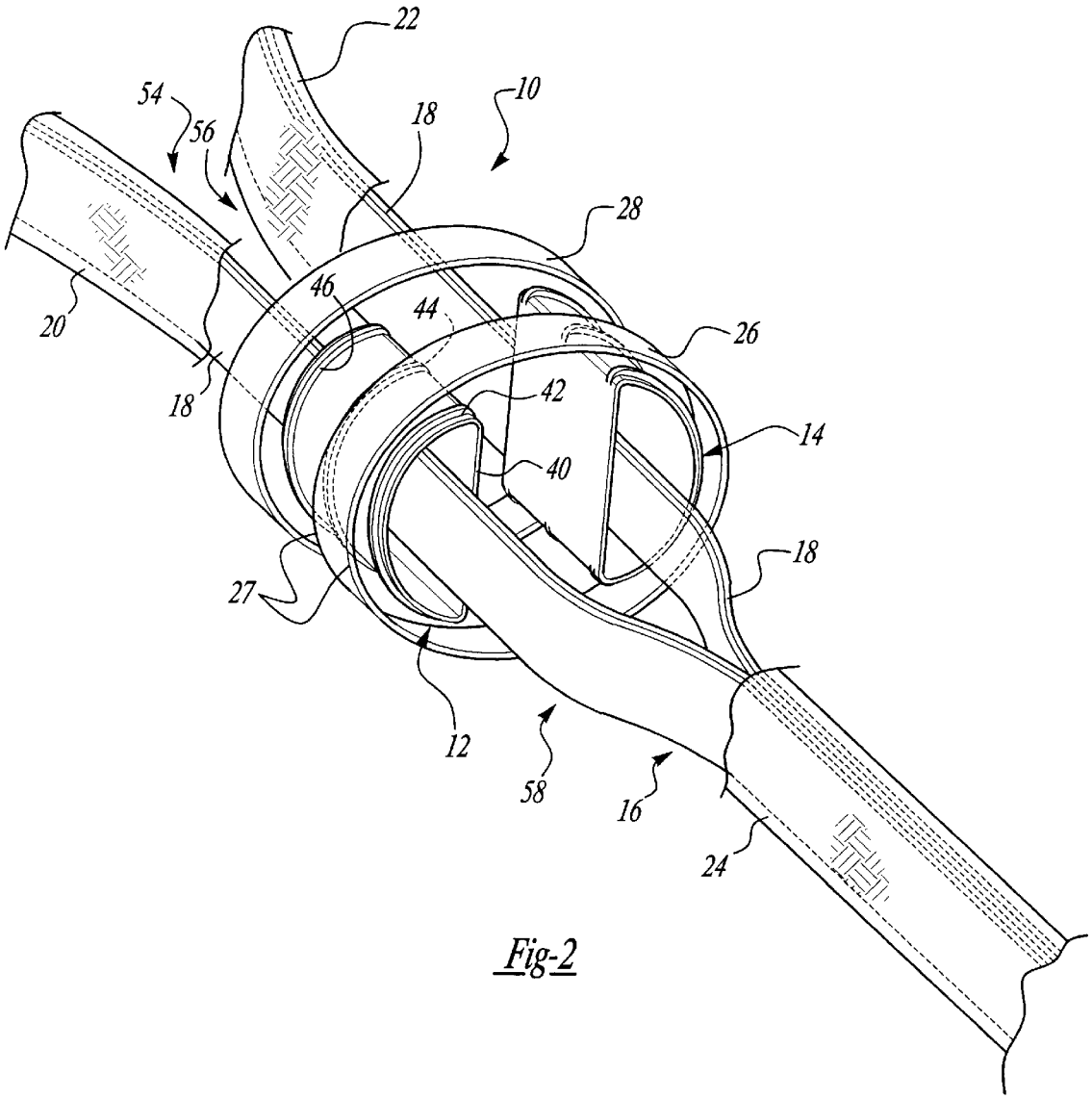
FIG. 2 is an exploded perspective view of the shield splitter assembly.

Referring to the drawings, a self-aligning shield splitter assembly 10 and a method of assembling the same are provided. As best seen in FIGS. 1 and 2, assembly 10 includes a first shield splitter 12 and a second shield splitter 14 for splitting and shielding a wiring bundle 16. Wiring bundle 16 includes a plurality of individual wires 18. Each of the plurality of individual wires 18 provides means for electrical communication between various electronic devices such as avionics components (not shown). Braided shields 20, 22, 24 are provided for shielding wiring bundle 16 from external electromagnetic fields, thereby minimizing noise in native electronic signals carried in the plurality of individual wires 18. Assembly 10 further includes a pair of retaining bands 26, 28 for securing first 12 and second 14 shield splitters together with braided shields 20, 22, 24 to form a shielded joint 30 at the splitting or branching point.

First 12 and second 14 shield splitters are identical and, thus in the interest of brevity, only first shield splitter 12 will be described with regard to their structure.

Figure 3:
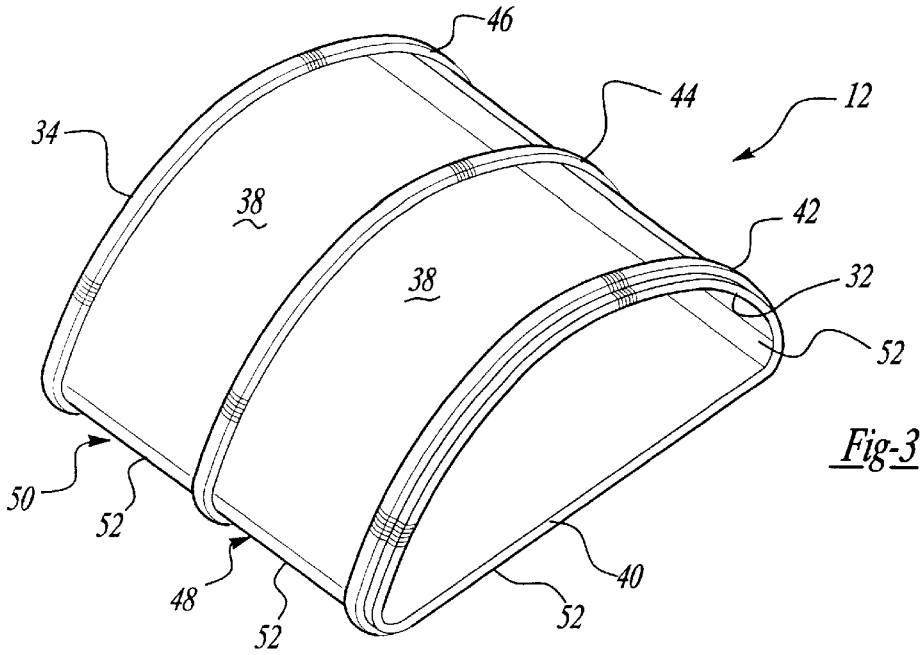
FIG. 3 is a perspective view of a semi-circular shield splitter.
Figure 4:
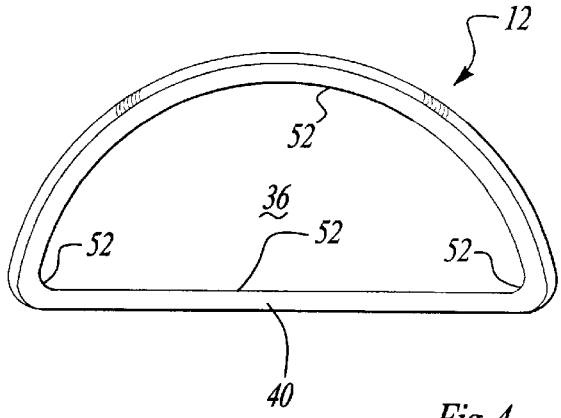
FIG. 4 is a front view of the semi-circular shield splitter of FIG. 3.
Figure 5:
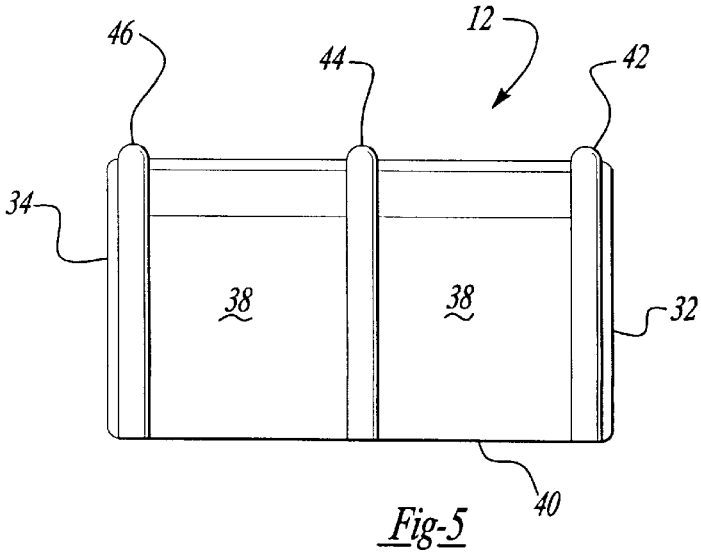
FIG. 5 is a side view of the semi-circular shield splitter of FIG. 3.

Referring now to FIGS. 3–5, first shield splitter 12 is preferably a hollow member having opened ends 32, 34, thereby defining an internal volume 36. First splitter 12 includes a generally circular or arcuate surface 38 and a generally flat surface 40. First splitter 12 further includes ridges 42, 44, 46 formed along a portion of generally arcuate surface 38. Preferably, ridges 42, 44, 46 are positioned perpendicular to a longitudinal axis A—A of first splitter 12 and extend completely along generally arcuate surface 38. More preferably, ridges 42, 46 are positioned along open ends 32, 34 of first splitter 12, respectively, and ridge 44 is positioned at a midpoint of first splitter 12. Such arrangement of ridges 42, 44, 46 thereby defines a pair of channels 48, 50 therebetween. By way of non-limiting example, first splitter 12 has a radius of approximately 0.25–0.625", a length of approximately 1", a wall thickness of approximately 0.050", and is formed by injection molding. Preferably, ridges 42, 44, 46 are approximately 0.030" above generally arcuate surface 38 and include rounded edges.

First splitter 12 still further includes a plurality of rounded edges 52. The specific advantage of the plurality of rounded edges 52 will be discussed in detail below.

Figure 6:
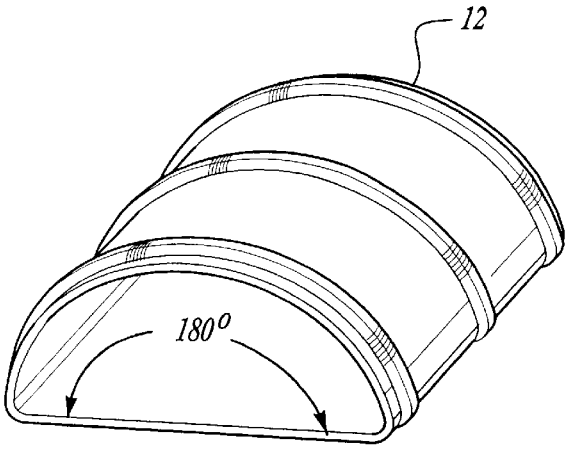
FIGS. 6–8 are perspective views of shield splitters having 180°, 90°, or 60° cross-sections.
Figure 7:
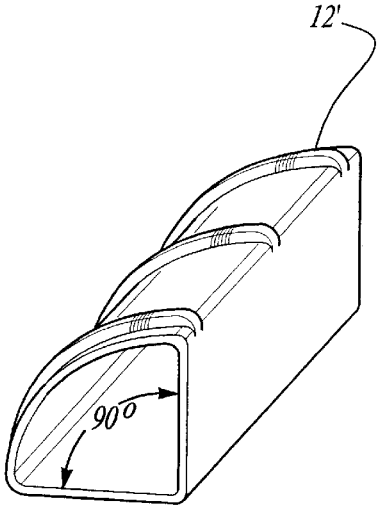
Figure 8:
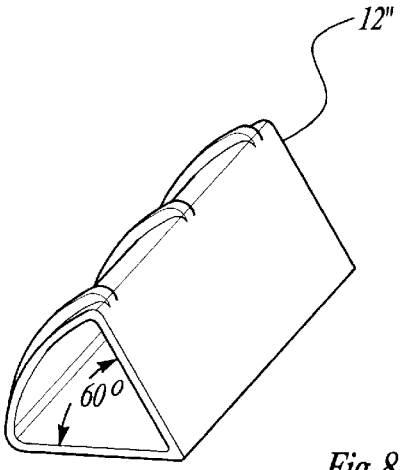

As best seen in FIGS. 6–8, first splitter 12 includes various configurations corresponding to portions of a circle. Preferably, generally arcuate surface 38 of first splitter 12 extends 180°, 90°, or 60°. However, it is anticipated that generally arcuate surface 38 may extend any portion of 360°, which is conducive to splitting wiring bundle 16.

Braided shields 20, 22, 24 are identical and, thus further in the interest of brevity, only braided shield 20 will be described with regard to their structure.

Figure 9:
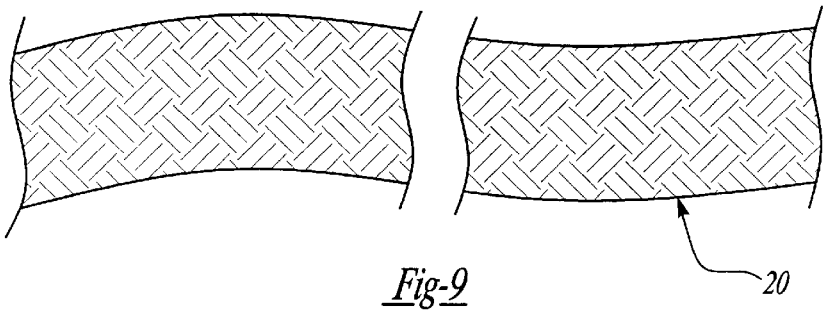
FIG. 9 is a side view of a slip-over type braided shield.

Referring to FIG. 9, braided shield 20 is a slipover type shield having a braided or woven structure. The woven structure of braided shield 20 resembles the woven structure of "Chinese fingercuffs," in that when the ends of braided shield 20 are pushed toward each other, the inner diameter of braided shield 20 increases and enables it to be slipped-over the plurality of individual wires 18. The ends of braided shield 20 may then be pulled to enclose the plurality of individual wires 18. Typically, slipover type shield material may be purchased in preformed rolls. To assemble, an operator simply unrolls the shield material, cuts it to length, and slips it over the wires that are to be shielded. Braided shield 20 is preferably made from plated copper strands, wherein the plating material is tin, nickel, or silver. However, it is anticipated that braided shield 20 may be made from any material possessing favorable shielding properties. It is further anticipated that the present invention may have utility with convention braided shields, which are formed on the wiring bundle during assembly of the aircraft.

Retaining bands 26, 28 are identical and, thus in the interest of brevity, only retaining band 26 will be described with regard to their structure.

Referring to FIGS. 1 and 2, retaining band 26 is preferably a metallic tie wrap or zip tie band fastened around first 12 and second 14 splitters of assembly 10. Retaining band 26 defines a width and a pair of edges 27. The width of retaining band 26 is less than the width of channel 48 to enable retaining band 26 to be positioned between ridges 42 and 44. Retaining band 26 is preferably ¼" or ⅛" wide and made of stainless steel to provide a strong and corrosion resistant means for securing multiple shield splitters together. Retaining band 26 is typically assembled using an applicator gun that tightens the metallic tie wrap around the shield splitters to a predetermined tension. The applicator gun then cuts the tie wrap to form a continuous band or ring. It should be appreciated that any retaining device capable of securing first 12 and second 14 splitters together, thereby providing a secure assembly for use in an aircraft may be used.

According to a preferred method for splitting a wiring bundle and shielding the wiring bundle from external electromagnetic fields, wiring bundle 16 having the plurality of individual wires 18 is first provided. By way of a non-limiting example, each of the plurality of individual wires 18 is 20–24 gauge and includes an insulating cover. It should be appreciated that virtually any gauge of wire or wiring system may be used that can readily fit within the shield splitter. For example, the plurality of individual wires 18 may be a Ribbonized Organized Integrated (ROI) wiring system (see FIG. 1*a*). ROI wiring systems include a series of individual wires that are woven into a flat ribbon. Multiple flat ribbons are separated by a foil layer and stacked on each other to form an organized ribbon of wires.

First hollow splitter 12 and second hollow splitter 14 are then provided. Wiring bundle 16 is then branched into a first portion 54 and a second portion 56. First portion 54 of wiring bundle 16 is inserted through internal volume 36 of first splitter 12, such that first splitter 12 is approximately located at the branching point of wiring bundle 16. Likewise, second portion 56 of wiring bundle 16 is inserted through the internal volume of second splitter 14, such that second splitter 14 is approximately located at the branching point adjacent to first splitter 12.

First braided shield 20 and second braided shield 22 are then provided for minimizing electromagnetic field penetration. First braided shield 20 is expanded by pushing the ends of first braided shield 20 toward each other. First braided shield 20 is then slipped over first portion 54 of wiring bundle 16 and first splitter 12, thereby enclosing and protecting first portion 54 and first splitter 12. Likewise, second braided shield 22 is expanded and slipped over second portion 56 of wiring bundle 16 and second splitter 14, thereby enclosing and protecting second portion 56 and second splitter 14. The rounded edges of ridges 42, 44, and 46 serve to prevent first braided shield 20 and second braided shield 22 from snagging on or otherwise tearing from contact with first splitter 12 or second splitter 14. Such snags or tears in first 20 or second 22 braided shields may enable electromagnetic fields to penetrate into wiring bundle 16, thereby introducing noise in the native signal.

Generally flat surface 40 of first splitter 12 is then positioned adjacent to the generally flat opposing surface of second splitter 14, such that first splitter 12 and second splitter 14 abut and are generally aligned. Since splitters 12, 14 are hidden from view during assembly, ridges 42, 44, and 46 provide the operator additional tactile features to aid in the general alignment of first splitter 12 relative to second splitter 14. By feeling ridges 42, 44, and 46 through first 20 and second 22 braided shields, the operator can align first splitter 12 and second splitter 14 more efficiently. First retaining band 26 is then provided for securing first splitter 12 and second splitter 14 together. First retaining band 26 is wrapped around first splitter 12, second splitter 14, first braided shield 20, and second braided shield 22. First retaining band 26 is then positioned within channel 48 surrounding first splitter 12 and second splitter 14, and secured using the applicator gun (not shown). In other words, first retaining band 26 is located between ridges 42 and 44 of both first splitter 12 and second splitter 14. First braided shield 20 and second braided shield 22 extend over first splitter 12 and second splitter 14, respectively, and are secured with first retaining band 26. By securing first retaining band 26 between ridges 42 and 44, first splitter 12 and second splitter 14 are longitudinally self-aligned. Similarly, by employing circularly shaped splitters, first splitter 12 and second splitter 14 are axially self-aligned. Ridges 42, 44 still further provide mechanical restrictions or barriers to prevent the retaining bands from being slipped or pulled off of the splitters after assembly.

If first splitter 12 and second splitter 14 are not axially-aligned correctly by the operator, the force of first retaining band 26 positioned around the first splitter 12 and second splitter 14 assembly will cause the axis of first splitter 12 to be automatically aligned with the axis of second splitter 14. Likewise, if first splitter 12 and second splitter 14 are not longitudinally-aligned correctly by the operator, the ridges 42, 44, and 46 will cause the first splitter 12 and second splitter 14 to be automatically aligned longitudinally. In other words, the braided shield extends over the ridges of the splitters, thereby providing pronounced ridges. These pronounced ridges are located on opposing sides of the retaining band. If first splitter 12 and second splitter 14 are not longitudinally aligned, then these pronounced ridges will not be aligned. However, the force of first retaining band 26 acting down upon the sloping portion of the pronounced ridges will cause the pronounced ridges to be defected, thereby self-aligning themselves relative to the edges of the retaining band 26. Such self-aligning of the pronounced ridges causes the first splitter 12 to be generally aligned with second splitter 14, thereby effecting a longitudinally self-alignment of the splitters 12, 14. By non-limiting example, it has been determined that if an operator can align first splitter 12 and second splitter 14 within approximately ¼", ridges 42, 44, and 46 will further self-align first splitter 12 and second splitter 14 to within a predetermined distance. It should be appreciated that for operator error greater than ¼", splitters may be manufactured having larger ridges to increase the pronounce ridge effect.

Figure 10A:
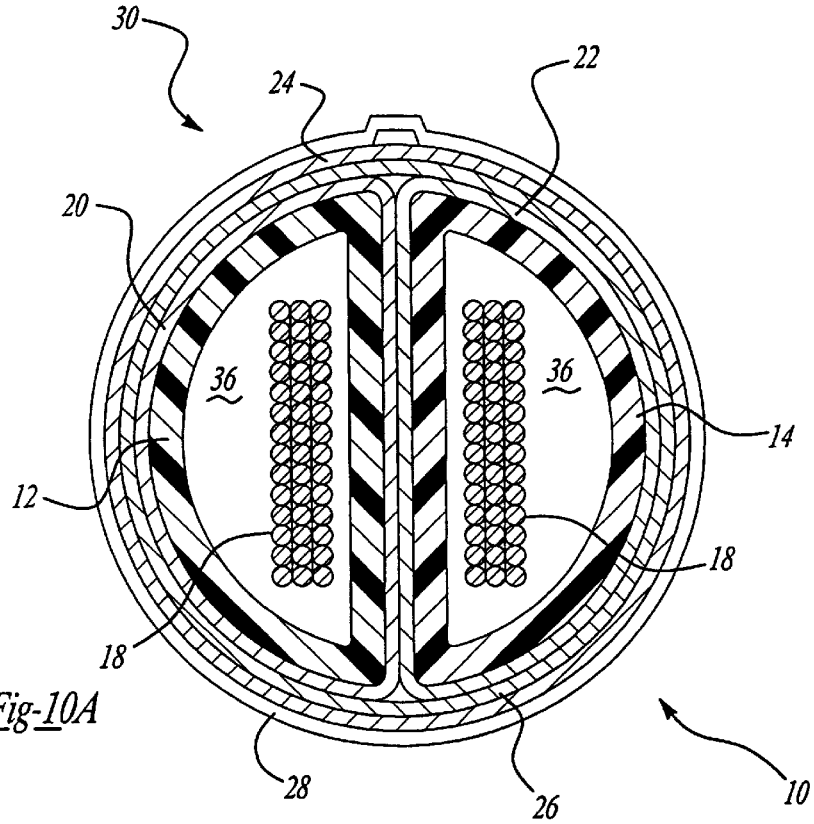
FIG. 10*a* is a cross-sectional view of FIG. 1, taken along line 10—10, showing the shield splitter assembly being used with a Ribbonized Organized Integrated (ROI) wiring system.
Figure 10B:
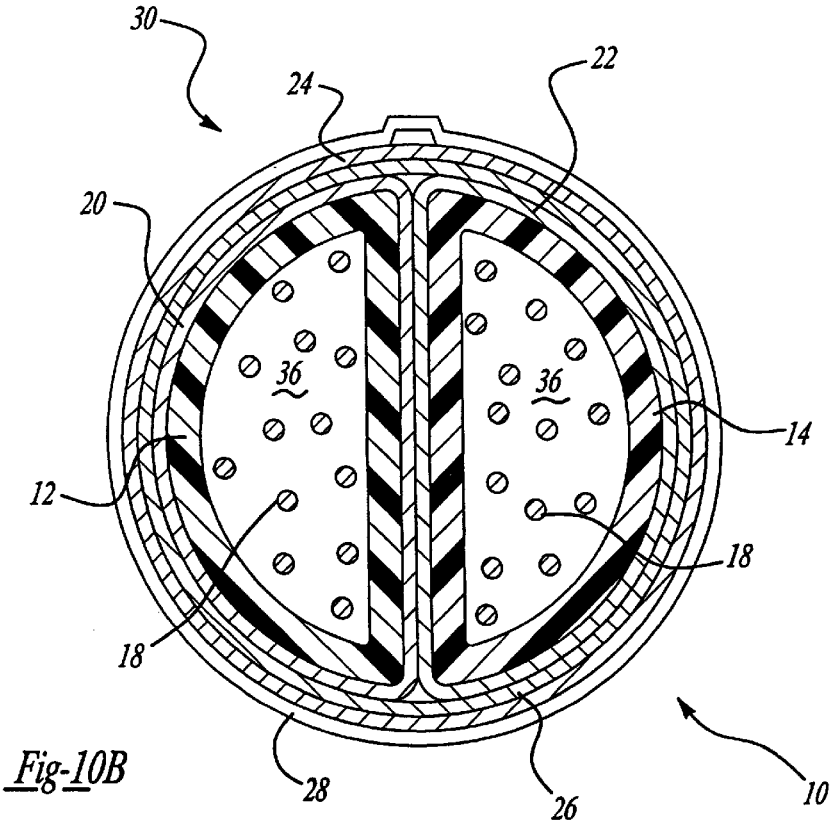
FIG. 10*b* is a cross-sectional view of FIG. 1, taken along line 10—10, showing the shield splitter assembly being used with a plurality of individual wires.

Third braided shield 24 is now provided for minimizing penetration of electromagnetic fields into a main portion 58 of wiring bundle 16. Similar to first braided shield 20 and second braided shield 22, third braided shield 24 is expanded and slipped over main portion 58 of wiring bundle 16. Third braided shield 24 is further slipped over splitters 12, 14 and first 20 and second 22 braided shields. Second retaining band 28 is then provided for securing third braided shield 24 over splitters 12, 14 and first 20 and second 22 braided shields. Second retaining band 28 is wrapped around first splitter 12; second splitter 14; braided shields 20, 22, 24; and first retaining band 26. Second retaining band 28 is then positioned within channel 50 and secured using the applicator gun (not shown). In other words, second retaining band 28 is located between ridges 44 and 46 such that it retains third braided shield 24 over the entire joint. Similar to first retaining band 26, second retaining band 28 further causes first splitter 12 and second splitter 14 to be longitudinally and axially self-aligned. Therefore, as best seen in FIGS. 10*a* and 10*b*, a shielded joint 30 having an overlapping design is provided that is essentially impervious to electromagnetic field penetration.

The plurality of rounded edges 52 of splitters 12, 14 are provided for preventing damage to the plurality of individual wires 18 and braided shields 20, 22, 24. Sharp edges are believed to damage the insulating cover of the wires, which may cause circuit damage or failure. Moreover, sharp edges are believed to damage braided shields by producing snags. These snags result in openings in the shield that enable electromagnetic fields to penetrate, causing noise to be induced into the native signal. The plurality of rounded edges 52 are believed to alleviate these problems and, further, simplify assembly.

Figure 11:
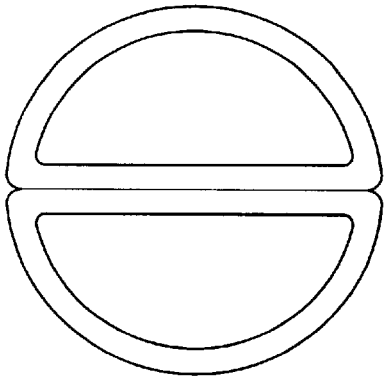
FIGS. 11–14 are front views of shield splitters assembled together according to alternative embodiments of the present invention.
Figure 12:
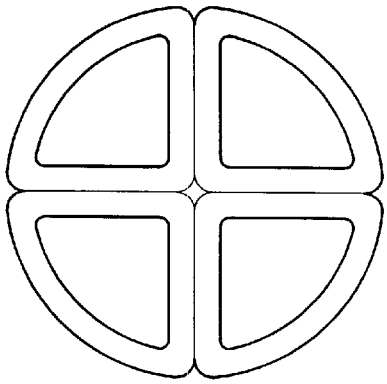
Figure 13:
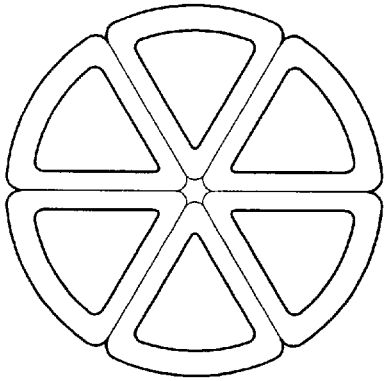
Figure 14:
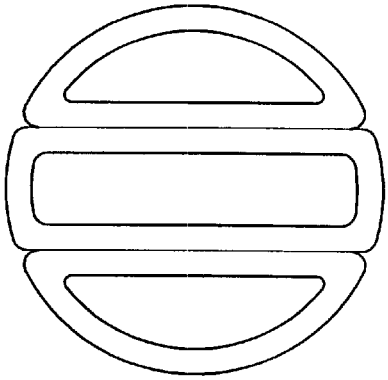

It should be appreciated that the present invention may include a plurality of shield splitters. Each of the shield splitters are adapted to be joined together to form a cylindrical self-aligning shield splitter assembly. As best seen in FIGS. 11–13, the plurality of shield splitters may be arranges to provide a splitter assembly that branches into two, four, or six portions. Furthermore, as best seen in FIG. 14, the plurality of shield splitters may be arranges to provide a splitter assembly that branches into three portions. This splitter assembly may include two semi-circular portions separated by a generally rectangular portion.

It should further be appreciated that the self-aligning shield splitter of the present invention enables wiring bundles to be simply and conveniently branched and shielded from electromagnetic fields. Unlike previous attempts, the present invention does not require an operator to manipulate an entire wiring bundle through a braiding machine in order to form a braided shield along a branched leg. Furthermore, the present invention employs preformed slip-over type braided shields, which may be simply unrolled from a spool, cut to length, and slipped over the wiring bundle. This slip-over type braided shield may be conveniently slipped back to expose the wiring bundle if service is required in the future, unlike the machine braided shield. Still further, the present invention includes a plurality of ridges, which provide means for self-aligning the shield splitter assembly to improve the integrity of the assembly and minimize the penetration of electromagnetic fields.

It should still further be appreciated that the self-aligning shield splitter of the present invention may be used as a tube sealing joint to protect the wiring bundle from environmental effects. More particularly, a wiring bundle may be branched into multiple portions and extended through a first splitter and a second splitter. If required, a glue or another adhesive may be disposed on the flat surfaces of the first and second splitters to bond the first and second splitters together. Shrinkable tubing is then extended over the branches and main leg of the wiring bundle. The shrinkable tubing may then be heated and shrunk around the wiring bundle to provide a sealed joint impervious to environmental effects. Retaining band may also be used if additional retaining force for the shrinkable tubing is needed.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A shield splitter assembly for splitting and shielding a wiring bundle from an electromagnetic field, said shield splitter assembly comprising:

a first hollow shield splitter defining an internal volume for receiving a first portion of the wiring bundle, said first splitter having open ends and a first and a second ridge disposed along an exterior surface of said first splitter generally perpendicular to a longitudinal axis of said first splitter;

a second hollow shield splitter defining an internal volume for receiving a second portion of the wiring bundle, said second splitter having open ends and a first and a second ridge disposed along an exterior surface of said second splitter generally perpendicular to a longitudinal axis of said second splitter;

a plurality of braided shields individually surrounding said first splitter said second splitter, and the wiring bundle, said plurality of braided shields minimizing penetration of electromagnetic fields into the wiring bundle; and at least one retaining band securing said first splitter, said second splitter, and said plurality of braided shields together, said at least one retaining band being positioned between said first and second ridges of said first and second splitters.

2. The assembly according to claim 1 wherein said plurality of braided shields includes:

a first braided shield substantially enclosing said first splitter and said first portion of the wiring bundle exiting said first splitter;

a second braided shield substantially enclosing said second splitter and said second portion of the wiring bundle exiting said second splitter; and a third braided shield substantially enclosing said first splitter, said second splitter, and the wiring bundle entering said first and second shield splitters.

3. The assembly according to claim 2 wherein said at least one retaining band includes:

a first retaining band securing said first and second splitters together such that said a flat surface of said first splitter abuts said flat surface of said second splitter, said first retaining band retaining said first and second braided shields adjacent said first and second splitters; and a second retaining band retaining said third braided shield adjacent said first and second braided shields.

4. The assembly according to claim 1 wherein said first and said second splitters each includes a generally arcuate surface and a flat surface, said first and second ridges of said first splitter extending along said arcuate surface of said first splitter, said first and second ridges of said second splitter extending along said arcuate surface of said second splitter.

5. The assembly according to claim 4 wherein said generally arcuate surface of each of said splitters subtends a predetermined angle, wherein said angle is 180°, 90°, or 60°.

6. The assembly according to claim 1 wherein each of said first and second splitters includes rounded edges for preventing damage to said plurality of braided shields and the wiring bundle.

7. A shield splitter for splitting wires in a harness into branches, said shield splitter comprising:

a hollow body defining an internal volume for receiving a plurality of wires, said body having open ends;

a first ridge and a second ridge extending along and above an exterior surface of said body so as to define a retaining channel, said first and second ridges being generally perpendicular to a longitudinal axis of said body;

whereby said shield splitter is adaptable to be secured to an adjacent shield splitter by a retaining band, each splitter receiving at least one of said plurality of wires through the open ends thereof from the harness to form separate branches, said exterior surface of said body being covered by shielding material, said ridges serving to maintain the retaining band within said retaining channel.

8. The shield splitter according to claim 7, further comprising:

a flat surface adaptable for abutting a flat surface of said adjacent shield splitter.

9. The shield splitter according to claim 8 wherein said exterior surface of said body is arcuate in shape and subtends a predetermined angle, wherein said angle is 180°, 90°, or 60°.

10. The shield splitter according to claim 7 wherein said body includes rounded edges for preventing damage to said plurality of wires.

11. A method for splitting wires in a wiring bundle into branches, comprising the steps of:

providing a wiring bundle having at least two wires;

providing a first hollow splitter and a second hollow splitter, each of said splitters having open ends and defining an internal volume, each of said splitters further having a pair of ridges extending outwardly along an exterior surface of said splitter, said pair of ridges being generally perpendicular to a longitudinal axis of said splitter;

splitting said wiring bundle into a first portion and a second portion;

inserting said first portion of said wiring bundle through said first splitter such that said first portion exits from said first splitter;

inserting said second portion of said wiring bundle through said second splitter such that said second portion exits from said second splitter;

providing a first braided shield and a second braided shield for minimizing electromagnetic field penetration;

slipping said first braided shield over said first portion of said wiring bundle and said first splitter;

slipping said second braided shield over said second portion of said wiring bundle and said second splitter;

providing a first retaining band for securing said splitters together; and positioning said first splitter adjacent said second splitter and securing said splitters together with said first retaining band such that said first retaining band overlaps said first and second braided shields.

12. The method according to claim 11, further comprising the steps of:

providing a third ridge extending outwardly along said exterior surface of each of said splitters, said third ridge being generally perpendicular to said longitudinal axis of said splitter and spaced apart from said pair of ridges thereby providing a space therebetween;

providing a third braided shield for minimizing penetration of electromagnetic fields;

slipping said third braided shield over said wiring bundle entering said first and second splitters, said third braided shield overlapping said splitters, said first and second braided shields, and said first retaining band;

providing a second retaining band for securing said third braided shield;

securing said second retaining band over said splitters, said first braided shield, said second braided shield, said third braided shield, and said first retaining band, said second retaining band being positioned in said space between said third ridge and said pair of ridges on each of said splitters, thereby providing a overlapping joint that minimizes penetration of electromagnetic fields into said wiring bundle.

13. The method according to claim 11 wherein each of said splitters further includes a generally arcuate surface and a flat surface, said pair of ridges and said third ridge extending along said arcuate surface of each of said splitters.

14. The method according to claim 13 wherein each of said generally arcuate surface of each of said splitters subtends a predetermined angle, wherein said angle is 180°, 90°, or 60°.

15. The method according to claim 11 wherein each of said splitters includes rounded edges for preventing damage to said braided shields and said wiring bundle.

* * * * *